United States Patent [19]

Goulter

[11] Patent Number: 4,886,173

[45] Date of Patent: Dec. 12, 1989

[54] COIL FOR STORING USED PLASATIC GROCERY BAGS

[76] Inventor: Victor H. Goulter, 485 Molimo Dr., San Francisco, Calif. 94127

[21] Appl. No.: 302,378

[22] Filed: Jan. 27, 1989

[51] Int. Cl.[4] ..... A47F 5/08

[52] U.S. Cl. ..... 211/89; 211/120

[58] Field of Search ..... 211/120, 6, 89, 69.8

[56] References Cited

U.S. PATENT DOCUMENTS

| | | | |
|---|---|---|---|
| 548,646 | 10/1895 | Lowry | 211/69.8 X |
| 635,283 | 10/1866 | Adair | 211/69.8 |
| 780,443 | 1/1905 | Phillips et al. | 211/120 X |
| 1,240,706 | 9/1917 | Gropengieser | 211/120 X |
| 2,482,258 | 9/1949 | Funk et al. | 211/120 X |
| 4,223,791 | 9/1980 | Taggart | 211/120 |

*Primary Examiner*—Robert W. Gibson, Jr.

*Attorney, Agent, or Firm*—David Pressman

[57] ABSTRACT

A flexible wire coil (12) has spaced loops (14) and inwardly bent end prong portions (16A and 16B). The prong portions are inserted in holes (18A and 18B) in ends (23A and 23B) of baseplate (22), which is secured by screws or adhesives (28) to insides of cabinet doors (32) or elsewhere in kitchens, or other places. Plastic grocery bags (24) can be stored between adjacent turns of the coil for later re-use as waste disposal bags. The coil is easily mounted on the baseplate by first stretching it, then inserting the prongs into the respective holes in the ends of the baseplate, and then releasing tension so that the coil's ends will grasp the baseplate securely, yet allow the coil to be compressed and expanded and flexed from side to side to facilitate use and prevent injury.

7 Claims, 5 Drawing Sheets

COIL FOR STORING USED PLASATIC GROCERY BAGS

BACKGROUND--FIELD OF INVENTION

This invention relates to the storing of plastic grocery bags, specifically to the storing of such bags in kitchens or elsewhere so that they can be re-used as receptacles for waste for disposal.

BACKGROUND--DESCRIPTION OF PRIOR ART

In the past, paper bags were generally used by food markets for packing groceries. After the groceries were unpacked, the bags were re-folded and placed in cupboard space for reuse as receptacles for kitchen waste. However, in recent years, markets have largely switched over to packing groceries in plastic bags, which—unlike paper bags—resist being refolded for short-time storage. Since the plastic bag has an expanding nature, even a few bags placed in a drawer will tend to fill it. Also, they require constant pushing back into the drawer each time it is opened. Moreover, in contrast to paper bags, the expanding nature of plastic bags does not permit them to be stacked one on top of the other.

Some people store several plastic bags inside another plastic bag, which they hang on a hook in the kitchen or elsewhere. However, due once again to the nature of the material of which they are made, plastic bags tend to expand and push one another out of the bag intended to contain them. Furthermore, a bulging bag full of other bags is unsightly. Nor is there any way to estimate the number of bags the householder has in storage, as a drawer or bag filled with bags gives no indication of how many are stored, three or four being expandable to take up as much room as 12 or 13. Bags also take up a disproportionate amount of space when stored in drawers, which could better be used for other items. Finally, when the householder attempts to take out one plastic bag for purposes of waste storage, several others usually cling, thus escaping from the drawer or container bag along with it.

OBJECTS AND ADVANTAGES

Accordingly, one object and advantage of the present invention is to provide a means for compacting the plastic bags into a small space, until such time as one or more is required to hold waste. Additional objects and advantages are to provide a means for controlling the expanding nature of the bags, to provide a means for storing the bags in an out-of-the-way place that would otherwise not be put to better use for storing other kitchen articles, to provide a means for storing the bags quickly and to facilitate the rapid removal of one or more as desired, and to provide a means for observing and assessing the number of bags on hand. Further objects and advantages of my invention will become apparent from a consideration of the drawings and ensuing description thereof.

REFERENCE NUMERALS

Figure 1:
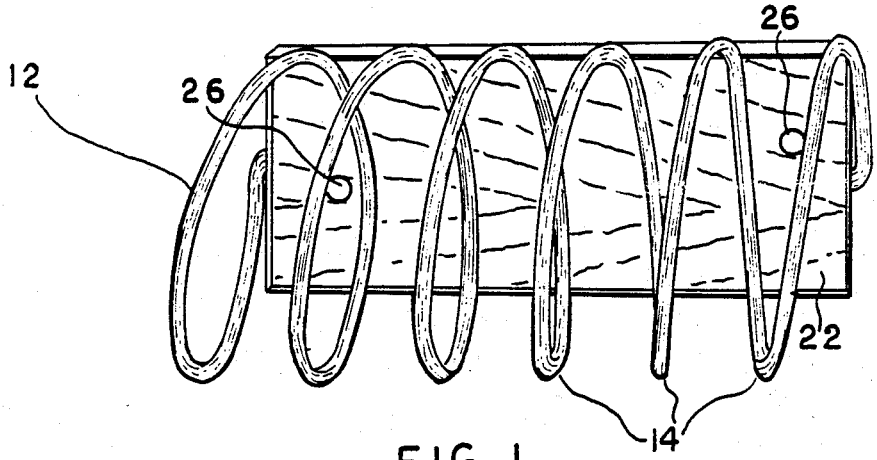
FIG. 1 is a front perspective view of a mounted bag storage coil according to the present invention.

12 coil
14 loops
16A and 16B prong portions
18A and 18B holes
22 baseplate
23A and 23B ends of baseplate
24 Plastic grocery bag
26 screw holes
28 adhesive
30 adhesive cover
32 cabinet door
33 part of bag
34 space between loops
35A and 35B loop extension
37A and 37B mounting surface
38 space inside coil
40 bulge
42 modified coil
44 front portion
46 intermediate coils
48 corrugations
50 metal loop
52 boss

DETAILED DESCRIPTION OF THE PREFERRED EMBODIMENT--FIGS. 1 & 2

Figure 3:
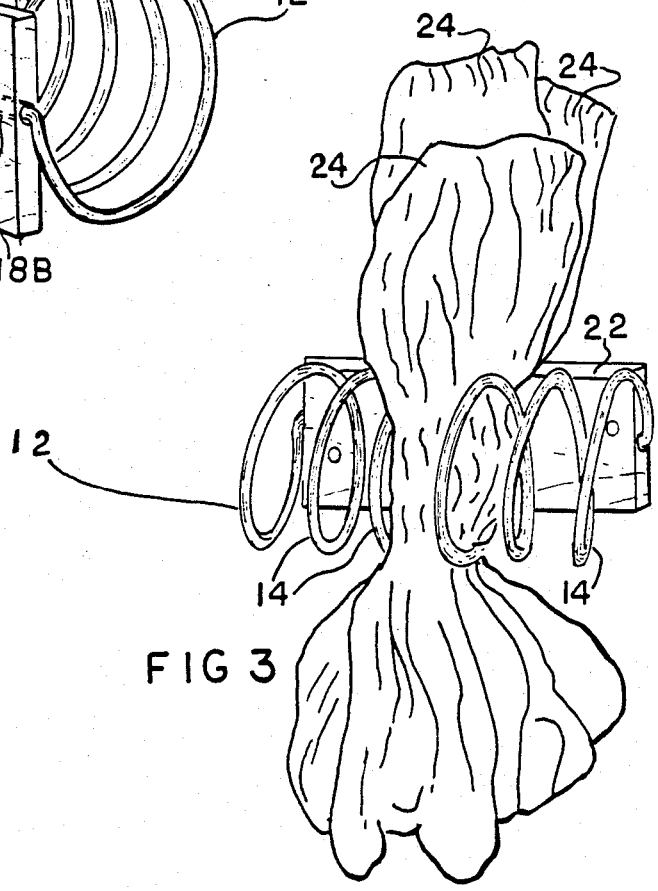
FIG. 3 is a front view of the coil holding three plastic grocery bags.

FIG. 1 shows a storage coil 12 mounted on a baseplate 22, according to the invention, for storing used plastic grocery bags of the type shown in FIG. 3. Although it can be made of any suitable material, coil 12 preferably is made of plated or plastic-covered steel, or brass wire of about 11 to 16 gauge (3 mm to 1.5 mm). A suitable coil diameter is 55 mm (2 ¼ in); however, it could be made from 25 mm to 75 mm (1 to 3 inches), or even larger, depending on the number of bags to be stored and the space available to mount it. In making the coil, the wire is wound to form a helical shape so that it has a series of adjacent loops 14, like a coil spring, the loops being spaced on baseplate 22 at about 20 to 25 mm (¾ to 1 inch) apart, providing slightly more than enough space to insert a finger. The coil thus forms an open helix; the helix has an imaginary longitudinal axis therethrough. Each end of coil 12 is bent at a right angle so that it extends back, outside the coil and parallel to its axis, to form two free ends or prong portions 16A and 16B, which point toward each other.

Figure 2:
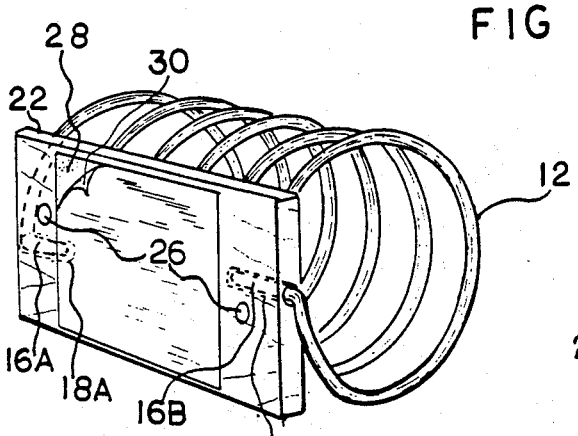
FIG. 2 is a rear view of the storage coil of FIG. 1.

Baseplate 22 can be made of wood, plastic, or any other suitable material and is provided with screw holes 26 for mounting in suitable locations in the kitchen or elsewhere. An alternative attaching means can be provided by an area of two-sided stick-on adhesive tape 28 (FIG. 2), wherein a protective cover or release paper 30 is removed before fixing. Any other adhesive attaching method would also be suitable. Holes 18A and 18B are formed in the respective longitudinal ends of baseplate 22. Preferably, these holes are very slightly larger than the 3 mm diameter of the coil material, in order to facilitate the insertion of prong portions 16A and 16B into the holes during assembly.

Figure 13:
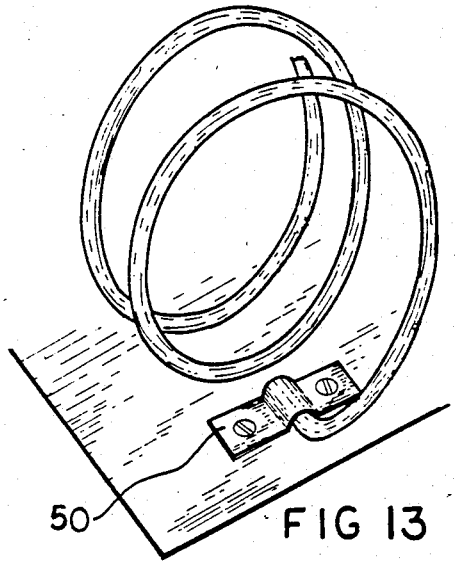
FIG. 13 is a perspective side view of one end of a storage coil mounted with a metal loop.
Figure 14:
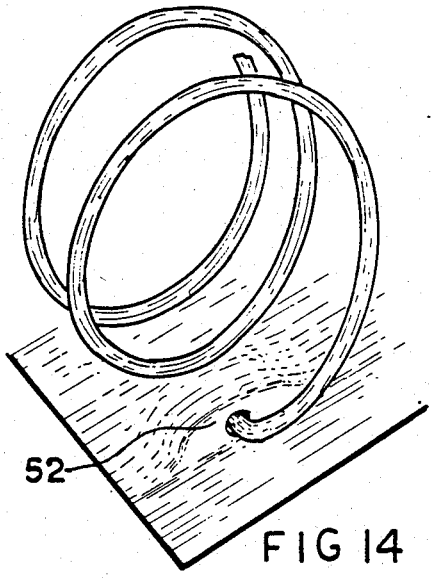
FIG. 14 is a perspective side view of one end of a storage coil mounted with a boss.

Preferably, coil 12 is made 20 to 25 mm ($\frac{3}{4}$ to 1 inch) shorter than baseplate 22. It can thereby be easily mounted on baseplate 22 by its own spring tension, as follows: first one prong portion, e.g., 16A, is inserted into hole 18A in baseplate 22. Then coil 12 is stretched lengthwise, like a tension spring, and prong portion 16B is inserted into hole 18B. Then both prong portions remain fully inserted in their respective holes under spring tension. Thus, coil 12 will be securely held to baseplate 22 by its prong portions. Coil 12 also can be mounted to a surface using metal loops 50 (FIG. 13) or to a boss 52 (FIG. 14).

OPERATION--FIGS. 3 TO 6

Figure 5:
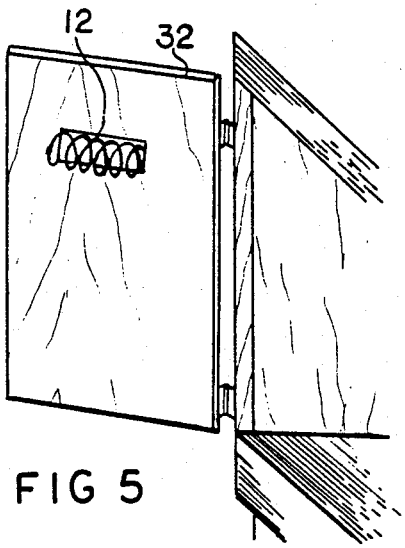
FIG. 5 is a perspective view of a mounted storage coil attached to the inside of a cabinet door.

The coil and baseplate assembly may be mounted horizontally, vertically, or diagonally, according to individual preference and/or available space Preferably the assembly is mounted behind a cabinet door 32 (FIG. 5), on cabinet sides or backs, or on walls, in drawers (not shown, or in any convenient space not required for other items.

Figure 4:
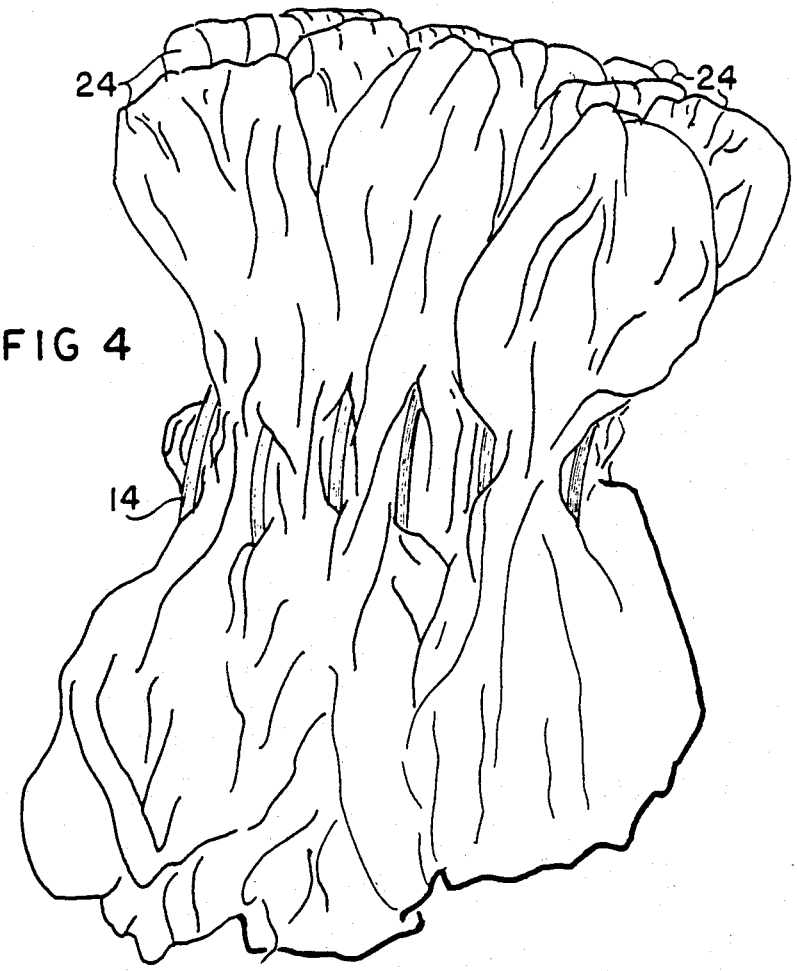
FIG. 4 is a perspective view of a storage coil holding twelve plastic grocery bags.

In order to place a plastic grocery bag between two adjacent loops 14 of coil 12, it is advantageous first to expel the air from the bag. One method of accomplishing this is to hold the bag at its closed end with one hand, then to grasp the other hand firmly around the bag and run the hand down from the closed end to the open end of the bag. This motion not only expels the air quickly from the bag, but also elongates the bag so that it can be folded in half easily, for greater ease in pushing it between any two adjacent loops 14 of storage coil 12, as shown in FIG. 3. By repeating this process, additional bags can be inserted between the same pair of adjacent loops, until capacity is reached. About three or four bags can be inserted between each adjacent pair of loops, as shown in FIG. 3, so that a total of about twelve to eighteen bags can be held by a five-space (six loop) coil unit, as shown in FIG. 4.

Figure 6:
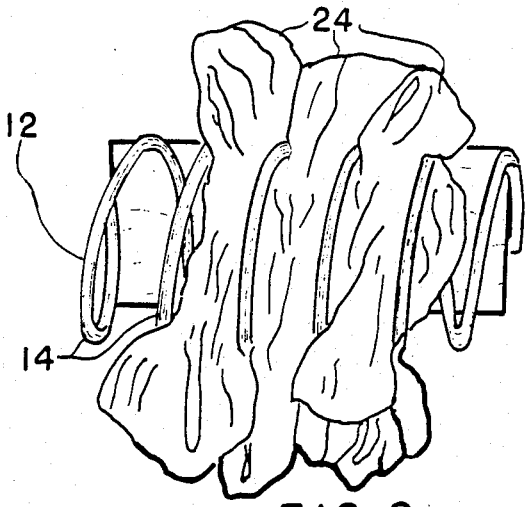
FIG. 6 is a perspective view of a mounted storage coil holding plastic grocery bags folded to a quarter of their normal length.

Alternatively, bags 24 can be folded in the middle and then folded again in the middle, to a quarter length, before insertion into the storage coil, this making for a more tidy and compact appearance (FIG. 6).

Figure 8:
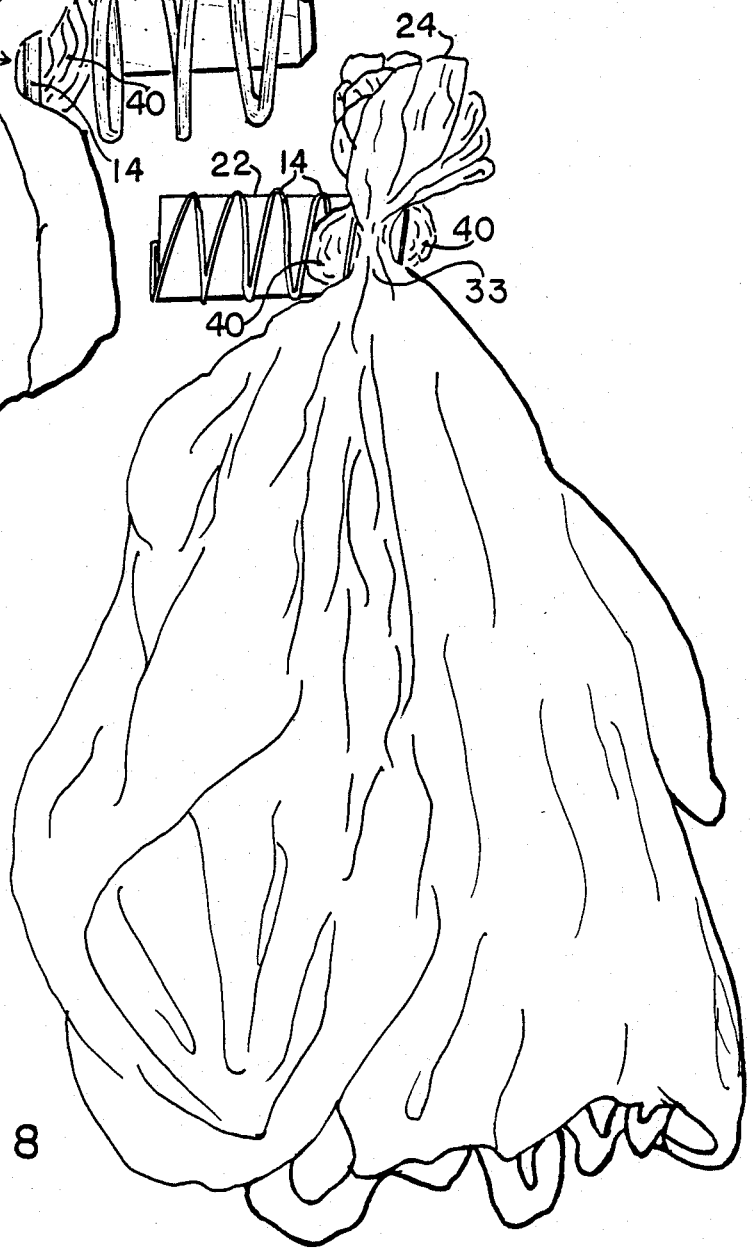
FIG. 8 is a perspective view of a mounted storage coil holding twelve unfolded bags in one coil storage space.

Still another method is to insert only the closed ends of the bags in the coils so that the bags hang in an upside-down manner, without any folding (FIG. 8). Although less tidy, it is possible by this method to hold as many as twelve plastic bags per space, or about 50 bags per coil.

METHODS OF BAG INSERTION--FIGS. 7 AND 8

Figure 7:
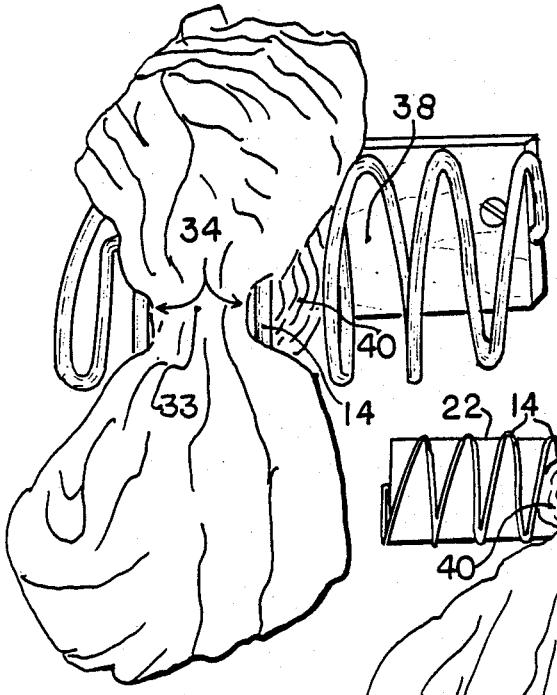
FIG. 7 is a perspective view of a mounted storage coil holding five bags folded to quarter length and fitted into one coil space.

The capacity of coil 12 to hold used plastic bags is due to the cooperating factors of both coil and bags. Since both have smooth, slippery surfaces, friction is not the primary holding factor. As mentioned earlier, since used plastic bags tend to expand, such that when a portion 33 of bag 24 (FIGS. 7 and 8) is pushed into space 34 between loops 14, portion 33 of the bag then expands sideways into space 38, thus forming a bulge 40, which assists in holding the bags in place. The greater the number of bags that are pushed in, the larger bulge 40 becomes. Moreover, the coil itself has a opposing springy or elastic nature, so that as more bags are inserted, the loops press circular indentations (not shown) into the sides of the plastic bags, thus anchoring them and holding them securely. Despite this secure hold, however, a bag can be readily removed without tearing, due to the smooth, slippery surfaces of both bag and coil, and also the tendency of the coil to roll slightly. Moreover, due both to bulge 40 and the elasticity of loops 14, when one bag is pulled out, it does not pull another bag along with it; rather, the second bag is left behind firmly in place.

MOBILITY OF COIL--FIGS. 9 and 11

Figure 9A:
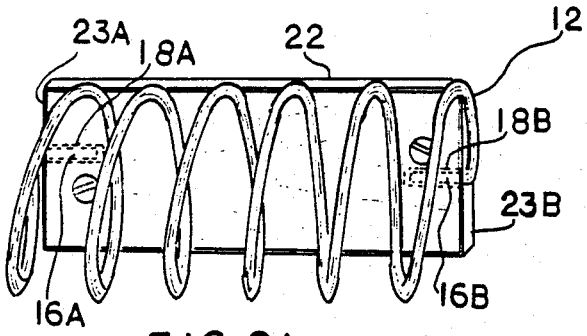
FIG. 9A is a perspective view of a mounted storage coil in normal position.
Figure 9B:
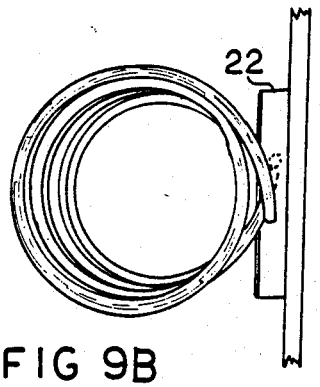
FIG. 9B is a perspective end view of FIG. 9A.

Since coil 12 (FIG. 9A and 11B) is attached to baseplate 22 only at its ends, i.e., by prong portions 16A and 16B, the coil will be able to move slightly. It can be rolled partially upward and downward, or flexed from side-to-side. FIGS. 9A and 9B show the neutral position of coil 12 on baseplate 22. Since prong portions 16A and 16B are inserted in respective holes 18A and 18B in ends 23A and 23B of baseplate 22, and since the coil is under spring tension, the intermediate loops of coil 12 can be flexed in a side-to-side manner. FIG. 8 shows two loops overloaded with five plastic bags folded to quarter length, thus causing a spreading apart of these two loops and consequential partial closing of the other loops.

Figure 10A:
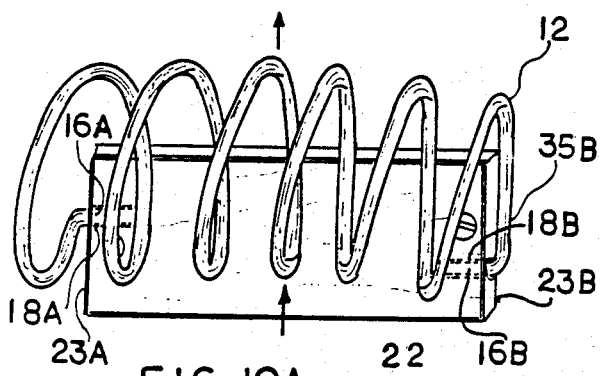
FIG. 10A is a perspective view of a storage coil flexed upward.
Figure 10B:
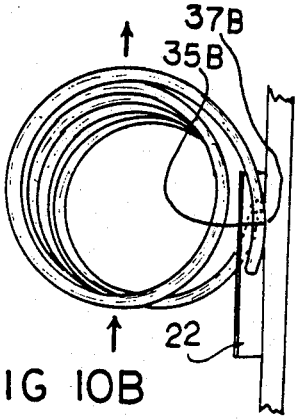
FIG. 10B is a perspective end view of FIG. 10A.
Figure 11A:
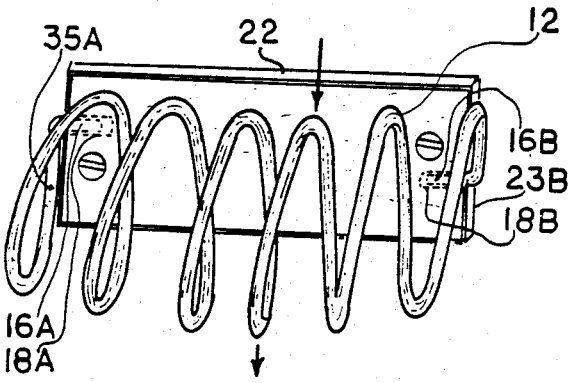
FIG. 11A is a perspective view of a storage coil flexed downward.
Figure 11B:
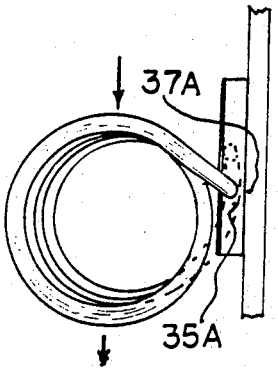
FIG. 11B is a perspective end view of FIG. 11A.

FIG. 10A and 10B show coil 12 flexed or rotated upward, due to either pushing force from below or pulling force from above, as indicated by the arrows. Coil 12 thus flexes to a point where the end 35B of the last loop contacts mounting surface 37B (FIG. 10B), preventing further upward movement. FIG. 11A shows coil 12 flexed or rotated downward, due to pushing or pulling forces, as indicated by the arrows, until end 35A of the last loop on the other end contacts mounting surface 37A at the opposite end of baseplate 22, thus limiting further rotation in a downward direction. This limited upward and downward flexure of coil 12 is advantageous when a bag is being removed from the coil, as the coil tends to roll, allowing the bag to be released from the coil's grip more easily.

The advantages of this mounting method are (1) the simple spring tension attachment of coil to base results in extreme ease and simplicity of manufacture; (2) the inward tension of the coil loops at each end allows them to remain fully effective in holding and storing bags over long periods of time (3) the capacity of the coils to compress and expand when greater than usual numbers of plastic bags are forcibly inserted; (4) the partial upward-and-downward flexibility of the coil allows for easier removal of bags. (5) the attachability of the coil to a baseplate of wood or plastic facilitates attachment of the unit to cabinet doors or other spaces by means of screws or adhesives; (6) the possibility of first plating or rubberizing the coils, so that they may later be attached to baseplates without the use of specialized tools.

CORRUGATED LOOPS—FIG. 12

Figure 12:
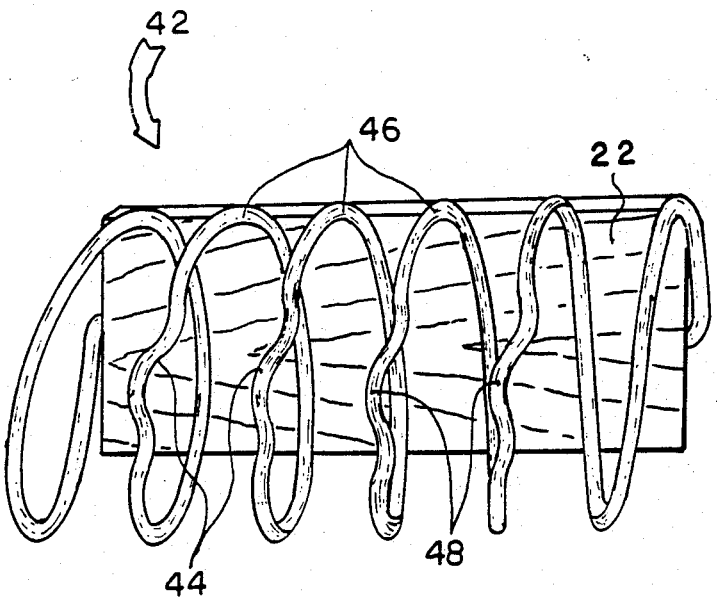
FIG. 12 is a perspective front view of a storage coil with wire loops which are partially corrugated.

FIG. 12 shows a modified storage coil 42 in which the front portion 44 of each intermediate loop 46 has corrugations 48. Corrugations 48 give added bag-retaining properties to coils 46, while still enabling one to easily insert used plastic grocery bags with the fingers. Assuming loops 46 are 55 mm (2 ¼ in) in diameter and are made of 3 mm (⅛ in) diameter wire, the front portion of each loop can have 3 complete sinusoidal-cycle corrugations, when viewed in a direction perpendicular to the major surfaces of baseplate 22. Each sinusoidal corrugation can have a peak-to-peak dimension of 20 mm (¾ in).

ALTERNATIVE MOUNTING METHODS—FIGS. 13 AND 14

The coil can be mounted by other means, such as by attaching directly with metal loops 50 (FIG. 13) onto a surface, or to holes in the ends of a boss 52 (FIG. 14) which is made integrally with and projects from a wall, door, or other surface, without a baseplate.

SUMMARY, RAMIFICATIONS, AND SCOPE

Thus, the reader will see that the present invention has many advantages over the prior art, i.e. when groceries are unpacked, the bags can be easily folded in half or quarter as desired and inserted immediately between the loops of a coil fitted in any handy place. In that position, the bags can remain in a neat, tidy and compact condition until one or more is required for kitchen waste. The bags can be fitted by their handles to a wastebasket which has been fitted by inventor's other patented invention, "Trash Container Attachment for Supporting Plastic Bags," Pat. No. 4,535,911 (1985). In a two year test period of the present invention, one coil was placed behind a cabinet door, while another was placed behind a sink cabinet door, adjacent to where the kitchen wastebasket was kept. This basket was fitted with a pair of attaChments of the type described above. At no time during the test period were the plastic bags stored in other than these two storage coils. At no time were they found to be untidy, out of position, lying around, or taking up space in drawers, etc. Usually, fifteen to twenty bags were kept in hand in the coils.

While the above description contains many specificities, the reader should not construe these as limitations on the scope of the invention, but merely as exemplifications of preferred embodiments thereof. Those skilled in the art will envision that many other possible variations are within its scope. For example, skilled artisans will readily be able to change the dimensions and shapes of the various embodiments, such as by making the coil longer, shorter, smaller, bigger, or oval, square or triangular, or by combining such varieties. As stated, the coil preferably is made of plated or plastic covered steel, i.e., the steel coil can be rubberized, which will have the effect of providing additional friction on inserted plastic bags and will also be softer to the touch. Moreover, such materials as plastic, fiber-reinforced resins, or other metals and alloys, apart from those specified, will be suitable, both for the coil and the baseplate. Coils mounted with brackets on surfaces or in a boss are less expensive alternatives to a baseplate-mounted coil. It is possible to have a coil of any suitable material, not mounted, to receive plastic bags, hung up or stuck up wherever convenient, or attached only at one end or place, or simply placed freely in a drawer or on a surface. Accordingly, the reader is requested to determine the scope of the invention by the appended claims and their legal equivalents, and not by the examples which have been given.

I claim:

1. A device for storing used plastic grocery bags, comprising:

an elongated elastic wire member having a helical shape so as to form a helix, said helix having adjacent turns which are spaced apart, thereby to form an open helix, said helix having an imaginary axis extending therethrough, said wire member having two free end portions at the respective ends of said helix, said end portions making a substantially right-angle bend with the respective adjacent portions of said helix, each end portion extending parallel to said axis and outside said helix, each end portion pointing to the opposite end portion, means for mounting said helix by said two free end portions such that any adjacent pair of turns of said helix can be compressed or expanded and said helix can rotate to a limited extent, said means comprising a rigid base with two major surfaces which are flat and parallel to each other and at least two end surfaces interconnecting said major surfaces, said end surfaces being parallel to each other and perpendicular to said major surfaces, each of said end surfaces having a hole therein, said free end portions of said wire member being inserted into said respective holes in said end surfaces, such that said helix is positioned adjacent one of said major surfaces, and such that said axis of said helix is parallel to said major surfaces, said wire member being free of any connection to said base other than by said end portions, such that any adjacent turns of said helix can be compressed or expanded, and such that said helix can rotate to a limited extent on said base, said helix being under tension so that it urges said free end portions together so as to compress said base between said ends thereof, whereby said device can be used to store a plurality of used plastic grocery bags in a rapid, convenient, and economical manner with one hand, and whereby any bag can be removed from storage for later re-use in an equally rapid and convenient manner with one hand.

2. The device of claim 1 wherein said base has a rectangular shape when seen from a given direction.

3. The device of claim 2 wherein said base is made of wood.

4. The device of claim 2 wherein said base is made of plastic.

5. The device of claim 1 wherein at least a portion of each of a plurality of turns of said helix is corrugated.

6. A method of storing used plastic bags, comprising:

A. providing a holder comprising an elongated plastic wire member mounted on a base, said wire member having a helical shape with adjacent turns which are spaced apart, thereby to form an open helix, said helix having an imaginary axis extending therethrough, said wire member having two free end portions at the respective ends of said helix, said end portions making a substantially right-angle bend with their respective adjacent portions of said helix, each end portion extending parallel to said axis and outside said helix, each end portion pointing to the opposite end portion, said base being rigid and having two major surfaces which are flat and parallel to each other and at least two end surfaces interconnecting said major surfaces, said end surfaces being parallel to each other and perpendicular to said major surfaces, each of said end surfaces having a hole therein, said free end portions of said wire member being inserted into said respective holes in said end surfaces, such that said helix is positioned adjacent one of said major surfaces, and such that said axis of said helix is parallel to said major surfaces, said wire member being free of any connection to said base other than by said end portions, such that any adjacent turns of said helix can be compressed or expanded, and such that said helix can rotate to a limited extent on said base, said helix being under tension so that it urges said free end portions together so as to compress said base between said ends thereof, B. compressing and holding a used plastic grocery bag manually so that its greatest dimension is smaller than when it is unfolded, so that said bag has a thickness which is greater than when it is unfolded, and so that if released, said bag will expand in thickness, C. inserting said bag in its compressed state between two adjacent turns of said helix, and D. releasing said bag so that it will expand and retain itself between said two adjacent turns, whereby a plurality of used plastic grocery bags can be stored in a rapid, convenient, and economical manner with one hand, and whereby any bag can be removed from storage for later re-use in an equally rapid and convenient manner with one hand.

7. The method of claim 6 wherein said base is mounted on a vertical surface so that said axis is vertical, whereby said bags will be held by friction with said coil turns and said holder can be stored on the inside of a cabinet.

* * * * *